US011545062B1

(12) United States Patent
Lin et al.

(10) Patent No.: US 11,545,062 B1
(45) Date of Patent: Jan. 3, 2023

(54) DYNAMIC REFERENCE VOLTAGE CONTROL IN DISPLAY DEVICES

(71) Applicant: HEWLETT-PACKARD DEVELOPMENT COMPANY, L.P., Spring, TX (US)

(72) Inventors: Yi-Fan Lin, Taipei (TW); Kai-Chieh Chang, Taipei (TW); Chang-Chih Yeh, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/363,527

(22) Filed: Jun. 30, 2021

(51) Int. Cl.

| | |
|---|---|
| ***G09G 3/30*** | (2006.01) |
| ***G09G 3/36*** | (2006.01) |
| ***G09G 3/20*** | (2006.01) |
| ***G05F 3/08*** | (2006.01) |

(52) U.S. Cl.
CPC ..... *G09G 3/20* (2013.01); *G05F 3/08* (2013.01); *G09G 2310/0297* (2013.01); *G09G 2310/08* (2013.01); *G09G 2340/0435* (2013.01); *G09G 2360/18* (2013.01)

(58) Field of Classification Search
CPC .... G09G 3/08; G09G 3/20; G09G 2310/0297; G09G 2310/08; G09G 2340/0435; G09G 2360/18
See application file for complete search history.

(56) References Cited

U.S. PATENT DOCUMENTS

| | | | | |
|---|---|---|---|---|
| 6,600,465 | B1 | 7/2003 | Koyama | |
| 9,508,294 | B2 | 11/2016 | He | |
| 9,620,068 | B2 | 4/2017 | Xu | |
| 10,269,316 | B2 | 4/2019 | Sakurai | |
| 10,424,244 | B2 | 9/2019 | Le et al. | |
| 2005/0177654 | A1* | 8/2005 | Tomohara | G09G 3/2096 710/22 |
| 2012/0249943 | A1* | 10/2012 | Pai | G09G 3/3655 349/139 |
| 2019/0371264 | A1* | 12/2019 | Koo | G09G 5/395 |
| 2021/0335315 | A1* | 10/2021 | Zhang | G09G 3/3688 |

* cited by examiner

*Primary Examiner* — Sanghyuk Park
(74) *Attorney, Agent, or Firm* — Quarles & Brady LLP

(57) ABSTRACT

In some examples, an electronic device comprises a voltage supply circuit to provide a reference voltage usable to discharge pixels in a display device; and a scaler circuit coupled to the voltage supply circuit. The scaler circuit is to buffer first and second frames and dynamically control the voltage supply circuit to modify the reference voltage based on a frequency of the first frame differing from a frequency of the second frame.

12 Claims, 6 Drawing Sheets

DYNAMIC REFERENCE VOLTAGE CONTROL IN DISPLAY DEVICES

BACKGROUND

Electronic devices such as televisions, notebooks, laptops, desktops, tablets, and smartphones are equipped with display devices. A display device displays images, such as documents, pictures, and videos, of an electronic device. To render quality images, the display device is to support different frame rates of the variety of images.

BRIEF DESCRIPTION OF THE DRAWINGS

Various examples are described below referring to the following figures.

DETAILED DESCRIPTION

Figure 1:
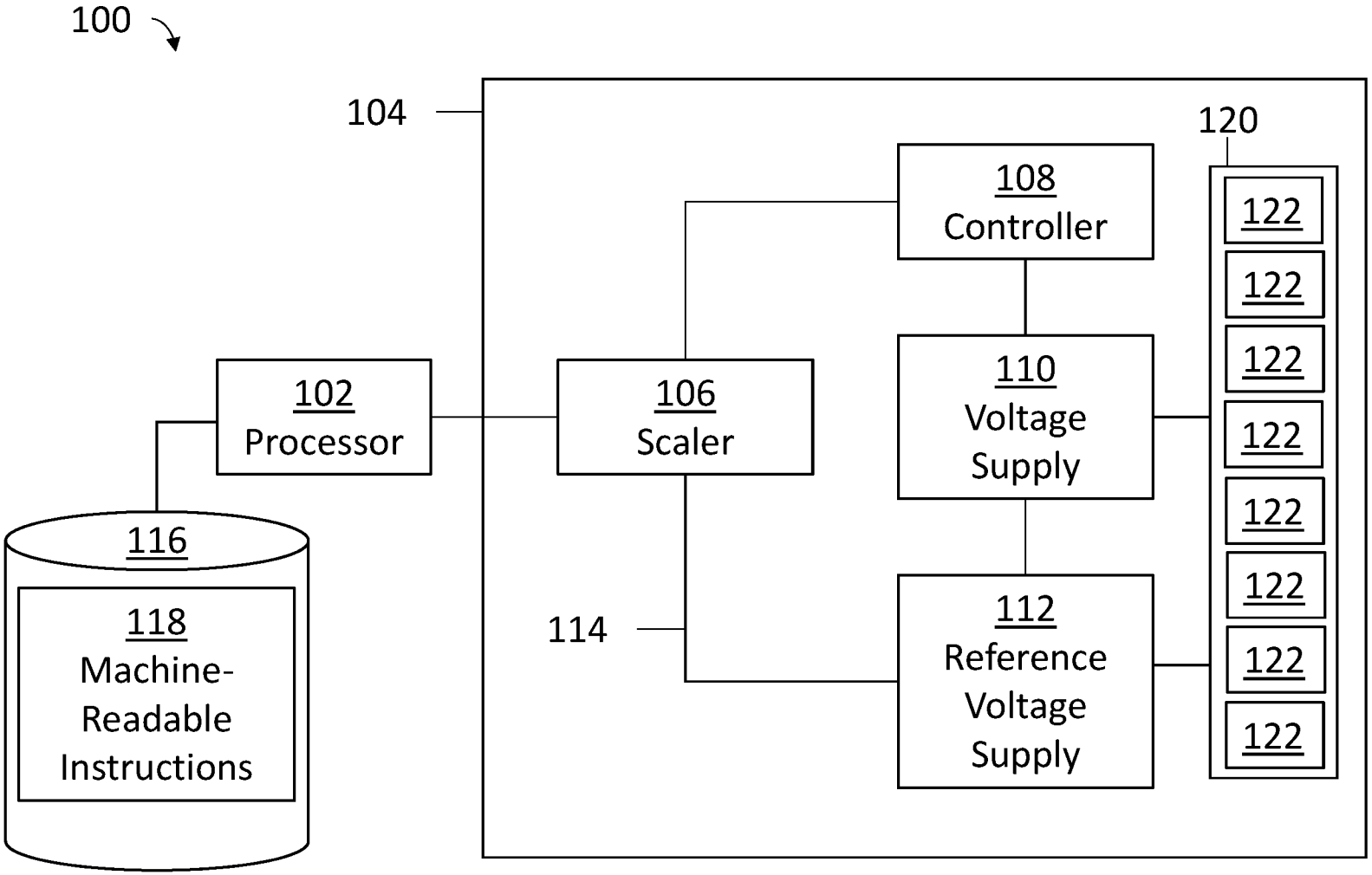
FIG. 1 is a schematic diagram of an electronic device for controlling reference voltage in a display device in accordance with various examples.

As described above, electronic devices may be equipped with display devices to render a variety of images that may have different frame rates. A frame rate, as used herein, is a measure of a number of frames, or images, per second that an electronic device may display. For instance, the electronic device may play a video at 60 frames per second (fps). To render an image, a display device charges and discharges pixels of a display panel. The display device has a frequency that is based on the charge and discharge rates of the pixels. The frequency is a measure of the number of times per second that the display device redraws the images on display. Refresh rate, as used herein, is the frequency of the display device. If the display device has a 60 Hertz (Hz) frequency and the electronic device plays the video at 60 fps, the redrawing of the images is indiscernible to a user.

A video game application (e.g., executable code, or machine-readable instructions, that enable a user to play a game) played on the electronic device may generate images at a variable frame rate. The variable frame rate enables the video game to generate more complex images (e.g., images having more data) in response to actions occurring within the video game. For instance, a first image of the video game may be a two-dimensional (2-D) image and a second image may be a three-dimensional (3-D) image. The 3-D image comprises more data that takes longer to render than the 2-D image. Tearing, or image splitting, occurs in response to the display device refreshing before the 3-D image fully renders. To prevent tearing, the display device may take longer to refresh the 3-D image (e.g., reduce the refresh rate). However, flickering of the display device occurs in response to a frequency of a subsequent frame exceeding the frequency of the previous frame because the pixels of the display panel have not had sufficient time to discharge. The flickering of the display device diminishes the user experience. Additionally, the unbalanced discharge of the pixels stresses the pixels, and the stress reduces a quality of the images displayed on the display panel over time.

This description describes an electronic device that reduces flickering of the display device by adjusting a reference voltage of the pixels to modify the discharge rate of the pixels. The electronic device adjusts the reference voltage in response to a variable frequency of image data transmitted to the display device. The image data may include audio data, video data, a frame rate, a frequency, or a combination thereof for a frame of the image data. Video data, as used herein, includes individual images as well as videos comprising multiple images, where an individual image is a subsequent frame of a previous individual image. The electronic device comprises a processor, a timing controller, a first voltage supply circuit, a second voltage supply circuit, and a scaler circuit comprising a buffer and a counter. The scaler circuit receives the image data from the processor and determines whether a second frame has a different frequency than a first frame. The second frame is subsequent and sequential to the first frame. In response to the second frame having a different frequency than the first frame, the scaler circuit adjusts a voltage of the second voltage supply. By adjusting the reference voltage supplied to the pixels, the stress on the pixels is reduced, flickering is mitigated, and the user experience is enhanced.

In some examples, an electronic device is provided. The electronic device comprises a voltage supply circuit to provide a reference voltage usable to discharge pixels in a display device; and a scaler circuit coupled to the voltage supply circuit. The scaler circuit is to buffer first and second frames and dynamically control the voltage supply circuit to modify the reference voltage based on a frequency of the first frame differing from a frequency of the second frame.

In some examples, an electronic device is provided. The electronic device comprises a processor and a display device coupled to the processor. The display device comprises a timing controller circuit a first voltage supply circuit coupled to the timing controller circuit, the first voltage supply circuit to provide a supply voltage to charge pixels in the display device, a second voltage supply circuit coupled to the first voltage supply circuit, the second voltage supply circuit to provide a reference voltage to discharge the pixels in the display device, and a scaler circuit coupled to the second voltage supply circuit and the timing controller circuit. The scaler circuit is to receive first and second frames from the processor, buffer the second frame, transmit the first frame to the timing controller circuit, responsive to a frequency of the second frame differing from a frequency of the first frame, control the second voltage supply circuit to dynamically adjust the reference voltage, and transmit the second frame to the timing controller circuit.

In some examples, an electronic device is provided. The electronic device comprises a first voltage supply to provide a driving signal to charge pixels in a display device, the driving signal having a variable frequency, a second voltage supply to provide a reference signal to discharge the pixels in the display device, and a scaler circuit coupled to the second voltage supply. The scaler circuit is to determine that a second image signal is to have a different frequency than a first image signal based on data stored in a buffer of the scaler circuit, and control the second voltage supply to vary an amplitude of the reference signal based on the determination.

Referring now to FIG. 1, a schematic diagram of an electronic device 100 for controlling reference voltage in a display device 104 is depicted in accordance with various examples. The electronic device 100 may comprise a processor 102, the display device 104, and a storage device 116. The electronic device 100 may be a television, a desktop, a laptop, a notebook, a tablet, a smartphone, or any other suitable electronic device including the display device 104. The processor 102 may be a microprocessor, a microcomputer, a microcontroller, a programmable integrated circuit, a programmable gate array, or other suitable device for managing operations of the electronic device 100. The display device 104 may be a liquid crystal display (LCD) display device 104, a light-emitting diode (LED) display device 104, a quantum dot (QD) display device 104, or any suitable display device 104 that includes pixels that have charge and discharge rates. The storage device 116 may be a hard drive, a solid-state drive (SSD), flash memory, random access memory (RAM), or other suitable memory device for storing data and executable code of the electronic device 100. The storage device 116 may store machine-readable instructions that, when executed by the processor 102, may cause the processor 102 to perform some or all of the actions attributed herein to the processor 102. The machine-readable instructions may be the machine-readable instructions 118.

The display device 104 may comprise a scaler 106, a controller 108, a voltage supply 110, a reference voltage supply 112, and a display panel 120. A scaler circuit, as used herein, is any circuit suitable for receiving and buffering image data, converting the image data from a first resolution to a second resolution, and driving the controller 108, the voltage supply 110, and the reference voltage supply 112 to display a frame of the image data on the display panel 120. The scaler 106 may be any suitable scaler circuit. As used herein, a timing controller circuit may be any suitable circuit for driving the display panel 120 according to a timing provided by the controller 108 to display the frame. The controller 108 may be any suitable timing controller circuit. The controller 108 may be a timing controller (TCON), for example. A voltage supply circuit, as used herein, is a circuit for supplying and regulating direct current (DC) voltages. The voltage supply 110 and the reference voltage supply 112 may be any suitable voltage supply circuits. The display panel 120 may be a liquid crystal display (LCD) panel, a light-emitting diode (LED) display panel, a quantum dot (QD) display panel, or any other suitable display panel 120 including pixels 122 that have charge and discharge rates.

In various examples, the processor 102 couples to the display device 104 and the storage device 116. In some examples, the processor 102 couples to the scaler 106. The scaler 106 couples to the reference voltage supply 112 via the path 114, the controller 108, and the processor 102. The controller 108 couples to the scaler 106 and the voltage supply 110. The voltage supply 110 couples to the controller 108, the reference voltage supply 112, and the display panel 120. The reference voltage supply 112 couples to the voltage supply 110, the scaler 106 via the path 114, and the display panel 120. The display panel 120 couples to the voltage supply 110 and the reference voltage supply 112. In some examples, the voltage supply 110 and the reference voltage supply 112 couple to thin-film transistors (TFTs) (not explicitly shown) that control the charge and the discharge rates of the pixels 122.

In some examples, the processor 102 may be a central processing unit (CPU). In other examples, the processor 102 may be a graphics processing unit (GPU). In various examples, the processor 102 may be any suitable device for processing image data that is input into the scaler 106.

While the display device 104 is shown as an in-built display device 104 of the electronic device 100, in other examples, the display device 104 may be coupled to the electronic device 100 via a wired connection (e.g., Universal Serial Bus (USB)), Video Graphics Array (VGA), Digital Visual Interface (DVI), High-Definition Multimedia Interface (HDMI), Mobile High-Definition Link (MHL), transistor-to-transistor logic (TTL)) or may be a stand-alone display device 104 coupled to the electronic device 100 via a wireless connection (e.g., WI-FI®, BLUETOOTH®). In some examples, the display device 104 may be a flexible display. Flexible display, as used herein, is a display device 104 that may be deformed (e.g., rolled, folded, etc.) within a given parameter or specification (e.g., a minimum radius of curvature) without losing electrical function or connectivity. The display device 104 may be a TFT LCD, an active matrix organic light emitting diode (AMOLED), an active matrix quantum dot light emitting diode (AMQLED), or a micro-light emitting diode (microLED), for example.

As described above, the electronic device 100 reduces flickering of the display device 104 by adjusting a reference voltage of the pixels 122 to modify the discharge rate of the pixels 122. The scaler 106 adjusts the reference voltage in response to a variable frequency of image data transmitted to the display device 104 from the processor 102. The scaler 106 receives the image data from the processor 102. The scaler 106 determines whether a second frame has a different frequency than a first frame. In response to the second frame having a different frequency than the first frame, the scaler 106 adjusts a voltage of the reference voltage supply 112. By adjusting the reference voltage supplied to the pixels, the stress on the pixels is reduced, flickering is mitigated, and the user experience is enhanced.

In various examples, the scaler 106 calculates a voltage to which to modify the reference voltage. The reference voltage is based on the frequency of the first frame and the frequency of the second frame. The scaler 106 determines a discharge rate of the pixels 122 displaying the first frame based on the first frequency. In some examples, the scaler 106 compares the first frequency to the second frequency. Based on a determination that the first frequency is a same frequency as the second frequency, the scaler 106 may maintain the reference voltage of the first frame. In other examples, the scaler 106 compares the discharge rate of the first frame to the frequency of the second frame. Based on a determination that the frequency of the second frame prevents the pixels 122 from discharging before rendering of the second frame, the scaler 106 adjusts the voltage of the reference voltage supply 112 to increase the discharge rate of the pixels 122. In various examples, the scaler 106 modifies the reference voltage responsive to a charge of the pixels. For example, responsive to the pixels 122 having a positive charge, the scaler 106 increases the reference voltage. Responsive to the pixels 122 having a negative charge, the scaler 106 decreases the reference voltage.

Figure 2:
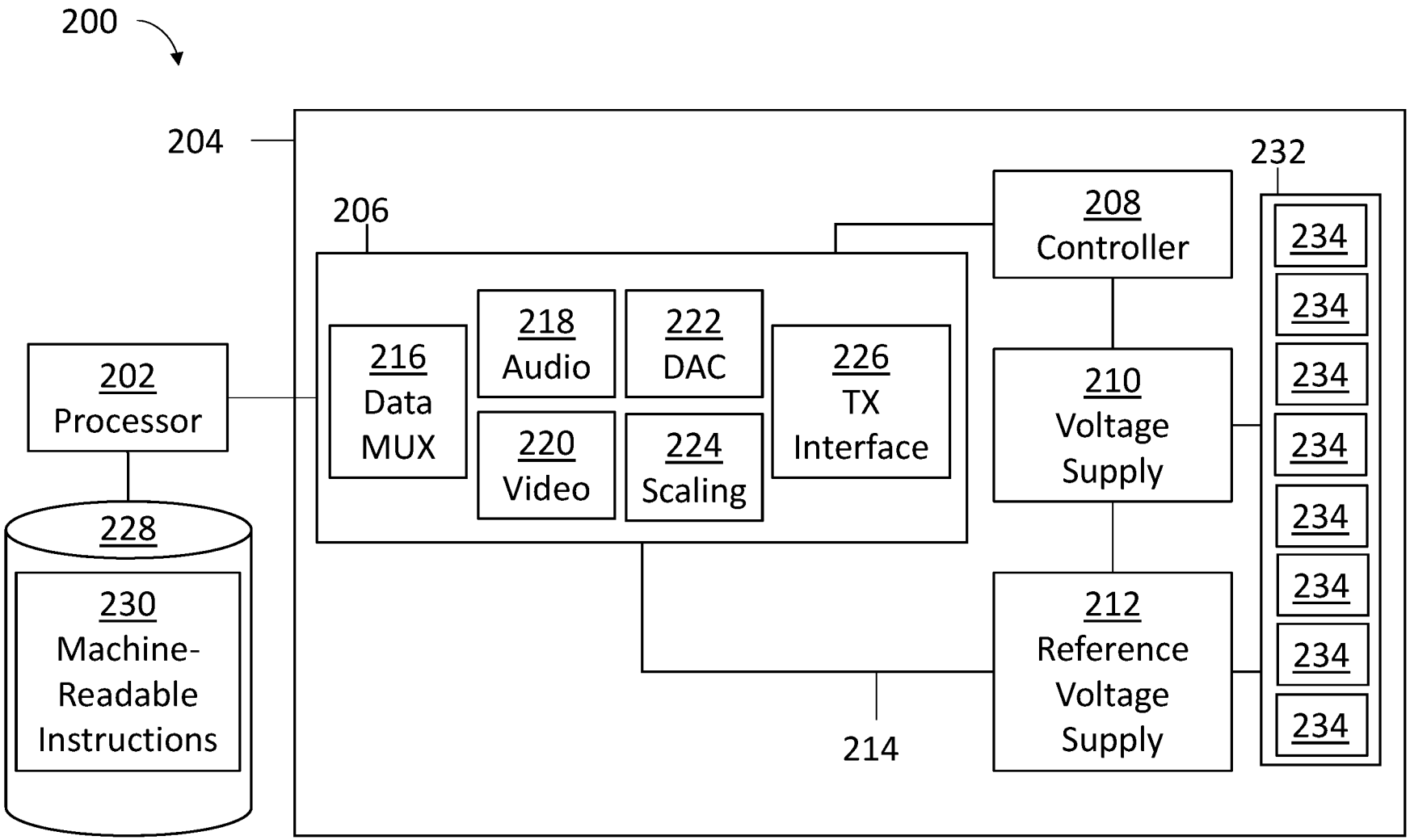
FIG. 2 is a schematic diagram of an electronic device for controlling reference voltage in a display device in accordance with various examples.

Referring now to FIG. 2, a schematic diagram of an electronic device 200 for controlling reference voltage in a display device 204 is depicted in accordance with various examples. The electronic device 200 comprises a processor 202, the display device 204, and a storage device 228. The processor 202 may be the processor 102. The display device 204 may be the display device 104. The storage device 228 may be the storage device 116. The storage device 228 may store machine-readable instructions that, when executed by the processor 202, may cause the processor 202 to perform some or all of the actions attributed herein to the processor 202. The machine-readable instructions may be the machine-readable instructions 230. The machine-readable instructions 230 may be the machine-readable instructions 118. The display device 204 may comprise a scaler 206, a controller 208, a voltage supply 210, a reference voltage supply 212 and a display panel 232. The scaler 206 may be the scaler 106. The controller 208 may be the controller 108. The voltage supply 210 may be the voltage supply 110. The reference voltage supply 212 may be the reference voltage supply 112. The display panel 232 may be the display panel 120. The display panel 232 includes pixels 234. The pixels 234 may be the pixels 122.

The scaler 206 may comprise a data multiplexer (MUX) (data MUX) 216, an audio processing (audio) circuit 218, a video processing (video) circuit 220, a digital-to-analog converter (DAC) 222, a scaling circuit 224, and a transmission (TX) interface 226. The data MUX 216 may be any circuit for receiving and routing image data having different input formats (e.g., VGA, DVI, HDMI). The audio circuit 218 may be any circuit to process or buffer audio data of the image data. Buffer, as used herein, is to store data in a storage device, or buffer, of a circuit. The video circuit 220 may be any circuit to process or buffer video data of the image data. In some examples, the audio circuit 218, the video circuit 220, or a combination thereof may comprise a counter. The DAC 222 may be any circuit for converting a digital input to an analog output. The scaling circuit 224 may be any circuit to convert a resolution of an input image to a resolution of an output image. The scaling circuit 224 may comprise a counter in some examples. The TX interface 226 may be any circuit for transmitting an output of the scaler 206 to the controller 208 and the reference voltage supply 212.

In various examples, the processor 202 couples to the display device 204 and the storage device 228. In some examples, the processor 202 couples to the scaler 206. The scaler 206 couples to the reference voltage supply 212 via the path 214, the controller 208, and the processor 202. The controller 208 couples to the scaler 206 and the voltage supply 210. The voltage supply 210 couples to the controller 208, the reference voltage supply 212, and the display panel 232. The reference voltage supply 212 couples to the scaler 206 via the path 214, the voltage supply 210, and the display panel 232. The display panel 232 couples to the voltage supply 210 and the reference voltage supply 212. In some examples, the voltage supply 210 and the reference voltage supply 212 couple to thin-film transistors (TFTs) (not explicitly shown) that control the charge and the discharge rates of the pixels 234.

As described above with respect to FIG. 1, the electronic device 200 reduces flickering of the display device 204 by adjusting a reference voltage of the pixels 234 to modify the discharge rate of the pixels 234. The scaler 206 adjusts the reference voltage in response to a variable frequency of image data transmitted to the display device 204 from the electronic device 200. The data MUX 216 receives the image data from the processor 202. The data MUX 216 determines a format of the image data and routes data of the image data to an appropriate buffer for processing. For example, the data MUX 216 routes audio data to the audio circuit 218 and video data to the video circuit 220. The data of the image data is stored in the buffer while awaiting transmission by the TX interface 226. The scaling circuit 224 determines whether a second frame of the video data has a different frequency than a first frame of the video data that is buffered in the video circuit 220. The scaling circuit 224 may utilize a counter to determine whether the second frame of the video data has a different frequency than a first frame of the video data that is buffered in the video circuit 220, for example. The scaling circuit 224 determines a discharge rate of the pixels 234 displaying the first frame. The scaling circuit 224 compares the discharge rate to the frequency of the second frame. Based on a determination that the frequency of the second frame prevents the pixels 234 from discharging before rendering of the second frame, the scaling circuit 224 calculates a voltage to which to modify the reference voltage based on the frequency of the first frame and the frequency of the second frame. In some examples, the TX interface 226 transmits the voltage to the reference voltage supply 212 to increase the discharge rate of the pixels 234. In other examples, the DAC 222 converts the voltage calculated by the scaling circuit 224 to an analog value. The TX interface 226 transmits the analog value to the reference voltage supply 212 to increase the discharge rate of the pixels 234. In various examples, the scaling circuit 224 modifies the reference voltage responsive to a charge of the pixels 234. For example, responsive to the pixels 234 having a positive charge, the scaling circuit 224 increases the reference voltage. Responsive to the pixels 234 having a negative charge, the scaling circuit 224 decreases the reference voltage. By adjusting the reference voltage supplied to the pixels, the stress on the pixels is reduced, flickering is mitigated, and the user experience is enhanced.

While the scaler 106, 206 is depicted as a component of the display device 104, 204, in some examples, the scaler 106, 206 may be external to the display device 104, 204. For example, the display device 104, 204 may be coupled to the electronic device 100, 200 via a wired or wireless connection, the scaler 106, 206 is internal to the electronic device 100, 200, and the scaler 106, 206 controls the reference voltage supply 112, 212 by transmitting a signal to the controller 108, 208.

Figure 3:
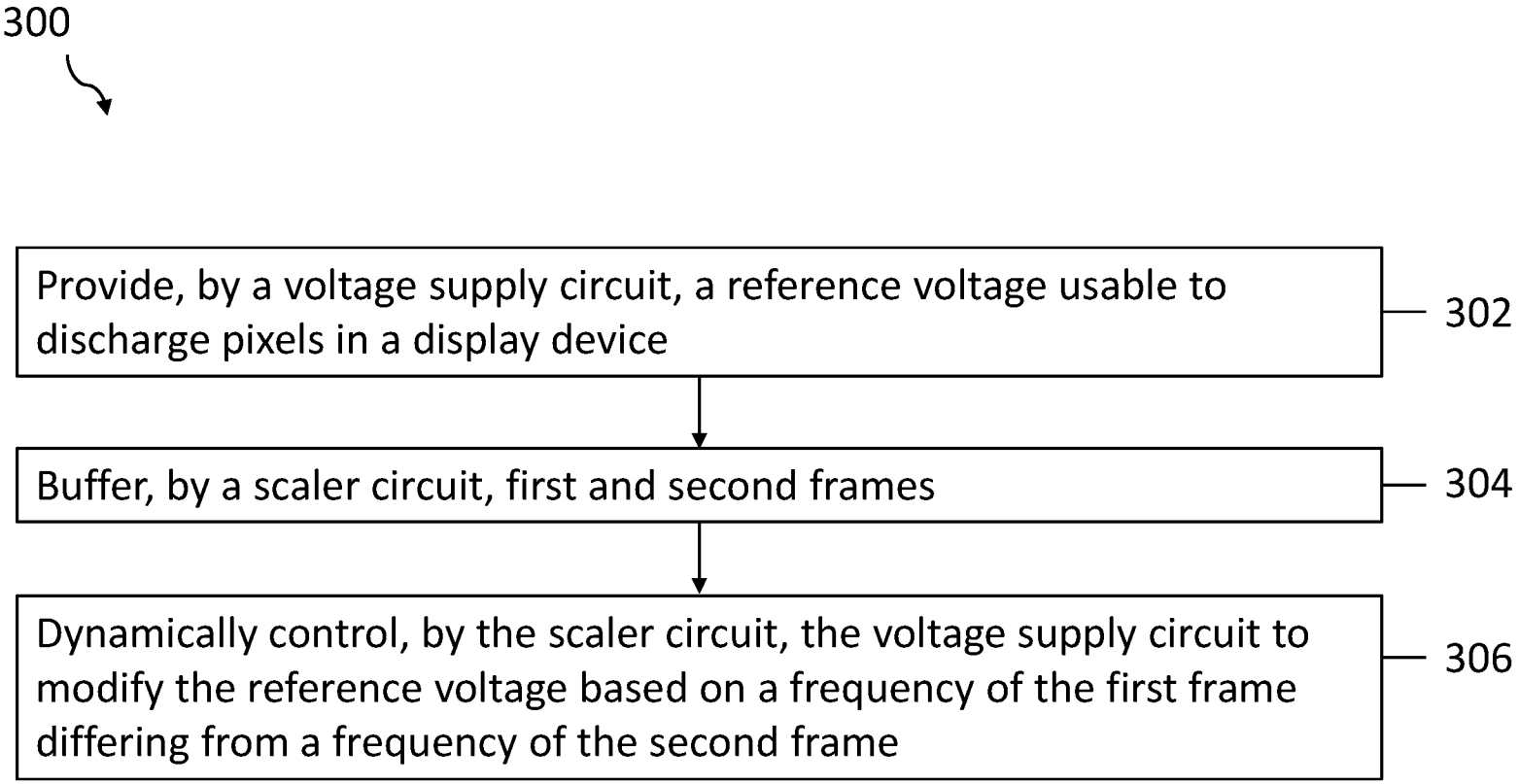
FIG. 3 is a flow diagram of method for controlling reference voltage in a display device in accordance with various examples.

Referring now to FIG. 3, a flow diagram of a method 300 for controlling reference voltage in a display device (e.g., the display device 104, 204) in accordance with various examples. The method 300 may be performed by the electronic device 100, 200. The method 300 includes providing, by a voltage supply circuit (e.g., the reference voltage supply 112, 212) a reference voltage usable to discharge pixels (e.g., the pixels 122, 234) in the display device (302). The method 300 also includes buffering, by a scaler circuit (e.g., the scaler 106, 206), first and second frames (304). Additionally, the method 300 includes dynamically controlling, by the scaler circuit, the voltage supply circuit to modify the reference voltage based on a frequency of the first frame differing from a frequency of the second frame (306).

In some examples, the method 300 includes controlling, by the scaler circuit, the voltage supply circuit to modify the reference voltage based on the frequency of the first frame. The method 300 also includes transmitting, by the scaler circuit, the first frame to a timing controller circuit. Additionally, the method 300 includes determining, by the scaler circuit, the frequency of the first frame differs from the frequency of the second frame. The method 300 also includes controlling, by the scalar circuit, the voltage supply circuit to modify the reference voltage based on the frequency of the second frame.

As discussed above with respect to FIG. 2, a video processing circuit (e.g., the video circuit 220) of the scaler circuit may buffer the first and the second frames. A transmission (TX) interface (e.g., the TX interface 226) of the scaler circuit may transmit the first frame to the timing controller circuit. In various examples, a DAC (e.g., the DAC 222) of the scaler circuit converts the buffered data from digital to analog values prior to transmission. In some examples, the method 300 includes determining, by a scaling circuit (e.g., the scaling circuit 224) of the scaler circuit, whether a second frame of the video data has a different frequency than a first frame of the video data that is buffered in the video processing circuit. The method 300 also includes, determining, by the scaling circuit of the scaler circuit, a discharge rate of pixels (e.g., the pixels 122, 234) displaying the first frame. Additionally, the method 300 includes comparing, by the scaling circuit of the scaler circuit, the discharge rate to the frequency of the second frame. Based on a determination that the frequency of the second frame prevents the pixels from discharging before rendering of the second frame, the method 300 includes, calculating, by the scaling circuit of the scaler circuit, a voltage to which to modify the reference voltage based on the frequency of the first frame and the frequency of the second frame. In various examples, the scaling circuit of the scaler circuit modifies the reference voltage responsive to a charge of the pixels. For example, responsive to the pixels having a positive charge, the scaling circuit of the scaler circuit increases the reference voltage. Responsive to the pixels having a negative charge, the scaling circuit of the scaler circuit decreases the reference voltage. The method 300 also includes converting, by the DAC, the voltage calculated by the scaling circuit of the scaler circuit to an analog value. The method 300 includes transmitting, by the TX interface of the scaler circuit, the analog value to the voltage supply to increase the discharge rate of the pixels.

In various examples, the method 300 includes buffering, by the scaler circuit, a third frame. The method 300 also includes, transmitting, by the scaler circuit, the second frame to the timing controller circuit. Additionally, the method 300 includes controlling, by the scaler circuit, the voltage supply circuit to maintain the reference voltage based on the frequency of the third frame having a same frequency as a frequency of the second frame. By dynamically adjusting the reference voltage supplied to the pixels, the scaler circuit reduces the stress on the pixels, mitigates flickering, and enhances the user experience.

Figure 4:
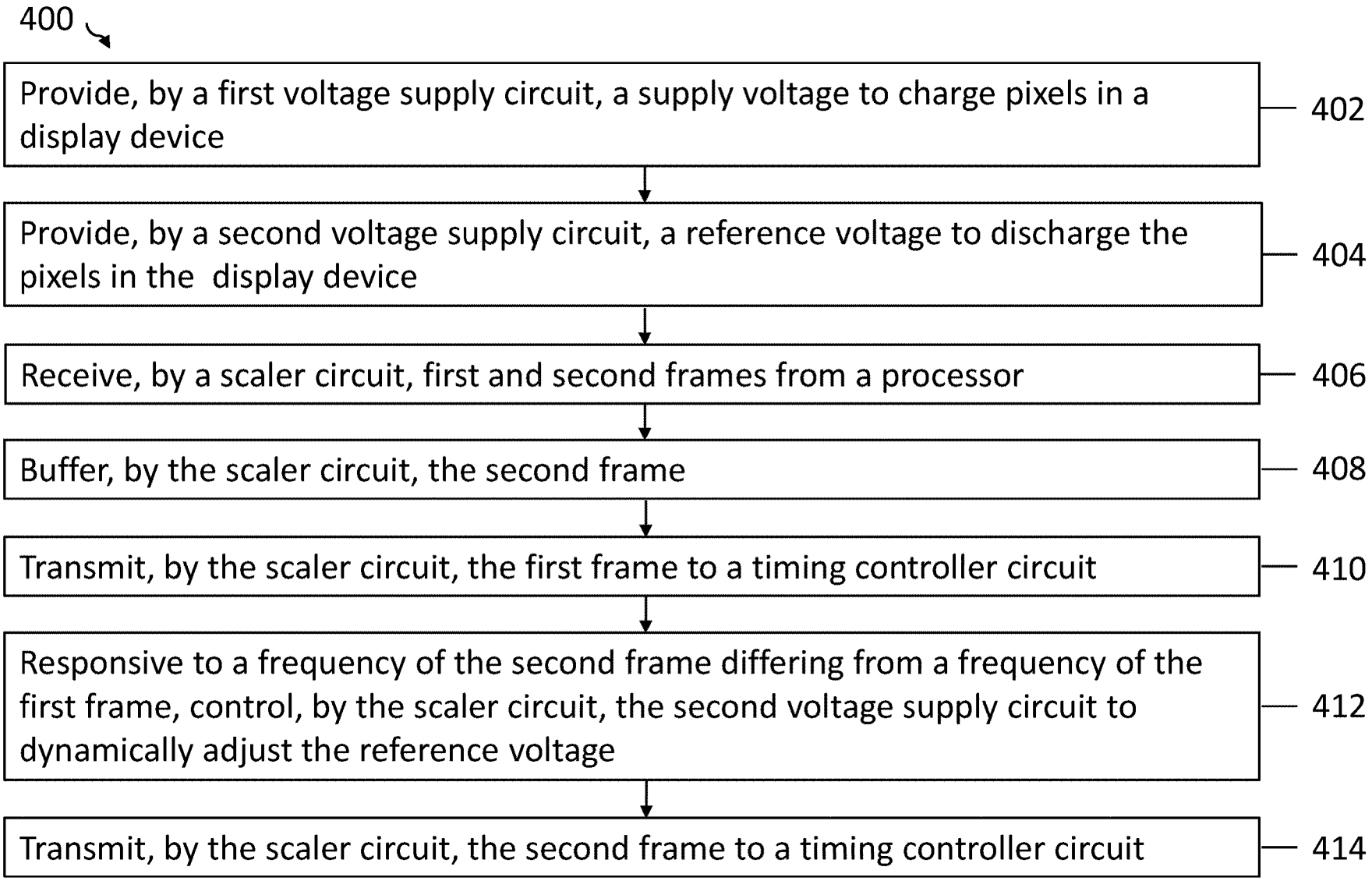
FIG. 4 is a flow diagram of method for controlling reference voltage in a display device in accordance with various examples.

Referring now to FIG. 4, a flow diagram of a method 400 for controlling reference voltage in a display device (e.g., the display device 104, 204) in accordance with various examples. The method 400 may be performed by the electronic device 100, 200. The method 400 includes providing, by a first voltage supply circuit (e.g., the voltage supply 110, 210), a supply voltage to charge pixels (e.g., the pixels 122, 234) in the display device (402). The method 400 also includes providing, by a second voltage supply circuit (e.g., the reference voltage supply 112, 212), a reference voltage to discharge the pixels in the display device (404). Additionally, the method 400 includes receiving, by a scaler circuit (e.g., the scaler 106, 206), first and second frames from a processor (e.g., the processor 102, 202) (406). The method 400 includes buffering, by the scaler circuit, the second frame (408). Additionally, the method 400 includes transmitting, by the scaler circuit, the first frame to a timing controller circuit (e.g., the controller 108, 208) (410). The method 400 also includes, responsive to a frequency of the second frame differing from a frequency of the first frame, controlling, by the scaler circuit, the second voltage supply circuit to dynamically adjust the reference voltage (412). The method 400 includes transmitting, by the scaler circuit, the second frame to a timing controller circuit (414).

In some examples, as described above with respect to FIGS. 2-3, the method 400 includes receiving, by a data MUX (e.g., the data MUX 216) of the scaler circuit, third and fourth frames from the processor. The method 400 also includes buffering, by a video processing circuit (e.g., the video circuit 220) of the scaler circuit, the third and the fourth frame. Additionally, the method 400 includes, responsive to a frequency of the third frame having a same frequency as the frequency of the second frame, dynamically controlling, by a scaling circuit (e.g., the scaling circuit 224) of the scaler circuit, the second voltage supply circuit to maintain the reference voltage. The method 400 includes transmitting, by a transmission (TX) interface (e.g., the TX interface 226) of the scaler circuit, the third frame. The method 400 also includes, responsive to a frequency of the fourth frame differing from the frequency of the third frame, dynamically controlling, by the scaling circuit of the scaler circuit, the second voltage supply circuit to adjust the reference voltage. In various examples, the scaling circuit of the scaler circuit modifies the reference voltage responsive to a charge of the pixels. For example, responsive to the pixels having a positive charge, the scaling circuit of the scaler circuit increases the reference voltage. Responsive to the pixels having a negative charge, the scaling circuit of the scaler circuit decreases the reference voltage.

Figure 5:
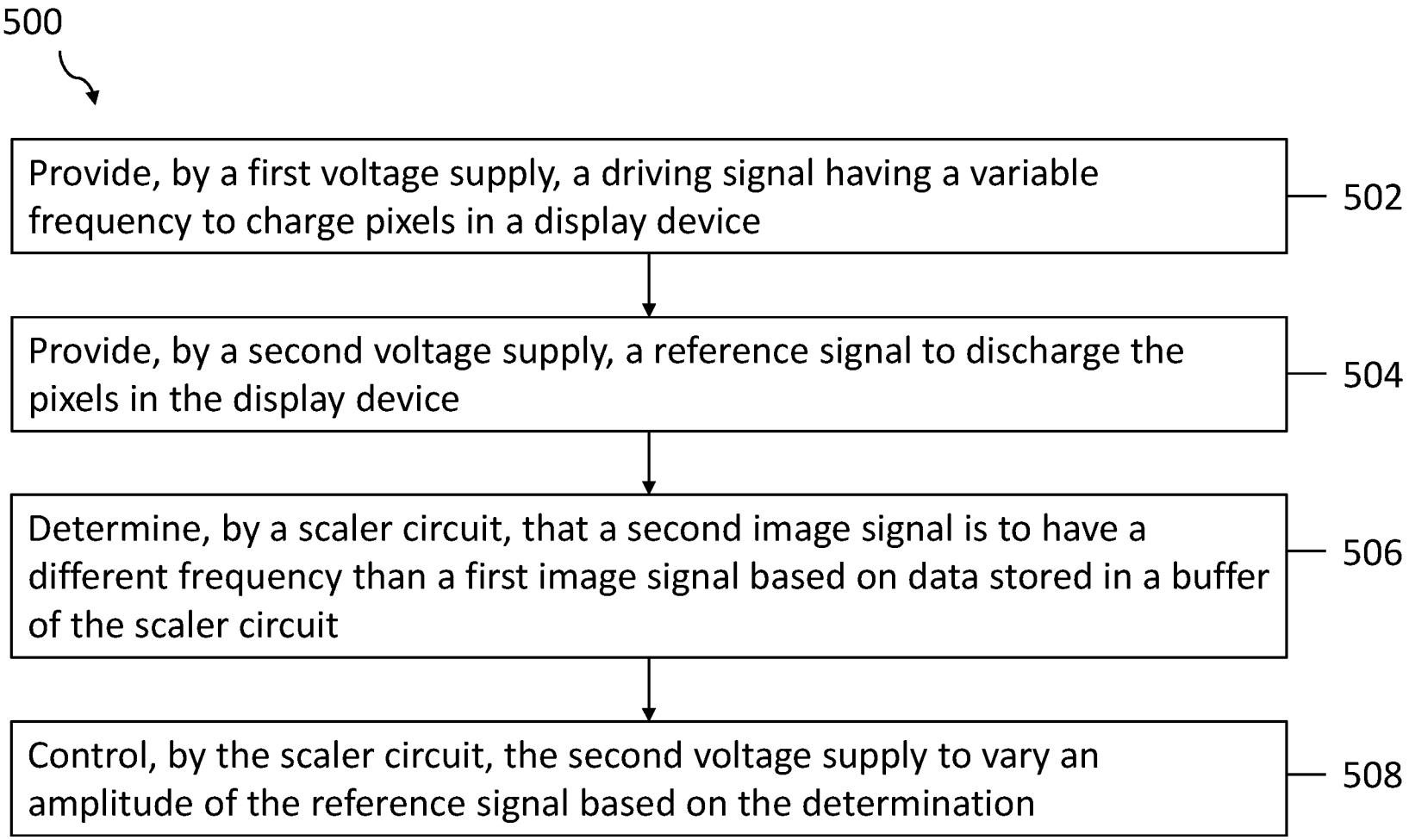
FIG. 5 is a flow diagram of method for controlling reference voltage in a display device in accordance with various examples.

Referring now to FIG. 5, a flow diagram of a method 500 for controlling reference voltage in a display device (e.g., the display device 104, 204) in accordance with various examples. The method 500 may be performed by the electronic device 100, 200. The method 500 includes providing, by a first voltage supply circuit (e.g., the voltage supply 110, 210), a driving signal having a variable frequency to charge pixels (e.g., the pixels 122, 234) in the display device (502). The method 500 also includes providing, by a second voltage supply circuit (e.g., the reference voltage supply 112, 212), a reference signal to discharge the pixels in the display device (504). Additionally, the method 500 includes determining, by a scaler circuit (e.g., the scaler 106, 206), that a second image signal is to have a different frequency than a first image signal based on data stored in a buffer of the scaler circuit (506). The method 500 includes controlling, by the scaler circuit, the second voltage supply circuit to vary an amplitude of the reference voltage based on the determination (508).

As described above with respect to FIGS. 1-4, in addition to having a variable frequency, the driving signal that charges the pixels may have a positive voltage or a negative voltage. In various examples, the scaler circuit modifies the reference voltage responsive to a voltage of the driving signal. In some examples, responsive to the driving signal having a positive voltage, the scaler circuit increases the amplitude of the reference signal based on the determination. Responsive to the driving signal having a negative voltage, the scaler circuit decreases the amplitude of the reference signal based on the determination. In other examples, the voltage of the driving signal varies from an upper limit voltage and a lower limit voltage. Responsive to the driving signal having the upper limit voltage, the scaler circuit increases the amplitude of the reference signal based on the determination. Responsive to the driving signal having the lower limit voltage, the scaler circuit decreases the amplitude of the reference signal based on the determination.

In various examples, as described above with respect to FIGS. 2-4, the method 500 includes receiving, by a data MUX (e.g., the data MUX 216) of the scaler circuit, the first and the second image signals. The method 500 also includes buffering, by the buffer (e.g., the video circuit 220), the second image signal. Additionally, the method 500 includes transmitting, by a transmission (TX) interface (e.g., the TX interface 226) the first image signal. The method 500 includes determining, by a scaling circuit (e.g., the scaling circuit 224) of the scaler circuit, whether the second image signal that is buffered by the buffer has a different frequency than the first image signal. The method 500 also includes, determining, by the scaling circuit of the scaler circuit, a discharge rate of the pixels driven by the first image signal. Additionally, the method 500 includes comparing, by the scaling circuit of the scaler circuit, the discharge rate to the frequency of the second image signal. Based on a determination that the frequency of the second image signal prevents the pixels from discharging before transmission of the second image signal, the method 500 includes, calculating, by the scaling circuit of the scaler circuit, an amplitude to which to modify the amplitude of the reference voltage signal based on the frequency of the first image signal and the frequency of the second image signal.

Though the actions of the methods 300, 400, 500 are depicted sequentially as a matter of convenience, at least some of the actions shown may be performed in a different order or performed in parallel. Additionally, some examples may perform only some of the actions shown. In various examples, at least some of the actions of the methods 300, 400, 500 may be implemented as instructions stored in a storage device and executed by a processor.

Figure 6:
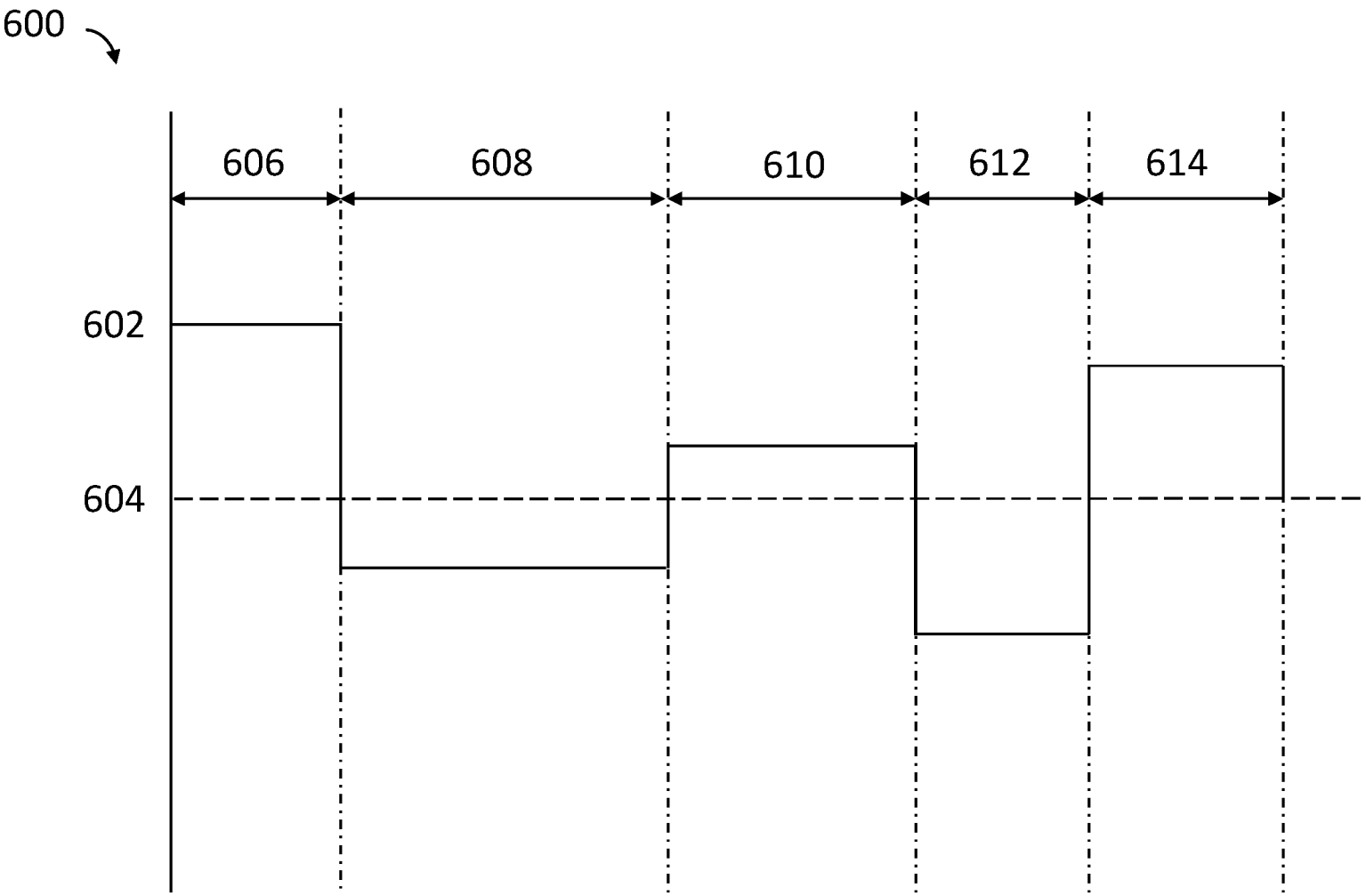
FIG. 6 is a timing diagram of an electronic device for controlling reference voltage in an example display device.

Referring now to FIG. 6, a timing diagram 600 of an electronic device (e.g., the electronic device 100, 200) for controlling reference voltage in a display device (e.g., the display device 104, 204) is depicted, in accordance with various examples. The timing diagram 600 illustrates a reference voltage signal 602 of the display device for time frames 606, 608, 610, 612, 614 during which images having variable frame rates are rendered. A baseline 604 illustrates a second reference voltage signal of a second display device for time frames 606, 608, 610, 612, 614 during which images having a non-variable frame rate are rendered.

A duration of the time frames 606, 608, 610, 612, 614 equals the inverse of an image refresh rate. For example, if the image refresh rate for a time frame 606 is 60 Hz, then a duration of the time frame 606 equals 1/60 seconds, or 0.016 seconds. As described above with respect to FIGS. 1-5, the variable frequency of the image signal results in the duration of the time frames 606, 608, 610, 612, 614 varying. As described above with respect to FIGS. 1-5, responsive to the driving signal having a positive voltage, the pixels (e.g., the pixels 122, 234) have a positive charge, and responsive to the driving signal having a negative voltage, the pixels have a negative charge. To increase the discharge rate of the pixels, a scaler circuit (e.g., the scaler 106, 206) of the electronic device may increase the reference voltage for pixels having a positive charge and may decrease the reference voltage for pixels having a negative charge utilizing the techniques described above with respect to FIGS. 1-5.

For example, the scaler circuit may determine the frequency of the image for display during the time frame 608 is different than the frequency of the image displayed during the time frame 606. Responsive to the pixels having a positive charge, the scaler circuit increases an amplitude of the reference voltage signal 602 for the time frame 606. The scaler circuit may determine the frequency of the image for display during the time frame 610 is different than the frequency of the image displayed during the time frame 608. Responsive to the pixels having a negative charge, the scaler circuit decreases the amplitude of the reference voltage signal 602 during the time frame 608. The resulting amplitude of the reference voltage signal 602 during the time frame 608 is less than the amplitude of the reference voltage signal 602 during the time frame 606. The scaler circuit may determine the frequency of the image for display during the time frame 612 is different than the frequency of the image displayed during the time frame 610. Responsive to the pixels having a positive charge, the scaler circuit increases the amplitude of the reference voltage signal 602 during the time frame 610. The resulting amplitude of the reference voltage signal 602 during the time frame 610 is greater than the amplitude of the reference voltage signal 602 during the time frame 608. The scaler circuit may determine the frequency of the image for display during the time frame 614 is different than the frequency of the image displayed during the time frame 612. Responsive to the pixels having a negative charge, the scaler circuit decreases the amplitude of the reference voltage signal 602 during the time frame 612. The resulting amplitude of the reference voltage signal 602 during the time frame 612 is less than the amplitude of the reference voltage signal 602 during the time frame 610. The scaler circuit may determine the frequency of the image for display during a subsequent time frame (not explicitly shown) to the time frame 614 is different than the frequency of the image displayed during the time frame 614. Responsive to the pixels having a positive charge, the scaler circuit increases the amplitude of the reference voltage signal 602. The resulting amplitude of the reference voltage signal 602 during the time frame 614 is greater than the amplitude of the reference voltage signal 602 during the time frame 612.

The baseline 604 illustrates the second display device having a static reference voltage. The static reference voltage has a value to balance a voltage supplied by a voltage supply (e.g., the voltage supply 110, 210) to the pixels. The value to balance the voltage of the voltage supply may be an average value of an upper voltage and a lower voltage supplied to a display panel (e.g., the display panel 120, 232) by the voltage supply. The static reference voltage may be 3.3 volts (V) for the voltage supply supplying a positive 6 V during a first time frame (e.g., the time frames 606, 610, 614) and supplying a −0.6 V during a second time frame (e.g., the time frames 608, 612), for example. In some examples, responsive to a non-variable frame rate, the electronic device 100, 200 may control the reference voltage supply to supply the static reference voltage.

By adjusting the reference voltage supplied to the pixels, the electronic device 100, 200 performing the method 300, 400, 500 reduces stress on the pixels, mitigates flickering, and enhances the user experience.

The above description is meant to be illustrative of the principles and various examples of the present description. Numerous variations and modifications become apparent to those skilled in the art once the above description is fully appreciated. It is intended that the following claims be interpreted to embrace all such variations and modifications.

In the figures, certain features and components disclosed herein may be shown in exaggerated scale or in somewhat schematic form, and some details of certain elements may not be shown in the interest of clarity and conciseness. In some of the figures, in order to improve clarity and conciseness, a component or an aspect of a component may be omitted.

In the above description and in the claims, the term "comprising" is used in an open-ended fashion, and thus should be interpreted to mean "including, but not limited to . . . ." Also, the term "couple" or "couples" is intended to be broad enough to encompass both direct and indirect connections. Thus, if a first device couples to a second device, that connection may be through a direct connection or through an indirect connection via other devices, components, and connections. Additionally, the word "or" is used in an inclusive manner. For example, "A or B" means any of the following: "A" alone, "B" alone, or both "A" and "B."

What is claimed is:

1. An electronic device, comprising:

a voltage supply circuit to provide a reference voltage usable to discharge pixels in a display device; and a scaler circuit coupled to the voltage supply circuit, the scaler circuit to:

buffer first and second frames; and dynamically control the voltage supply circuit to modify the reference voltage based on a frequency of the first frame differing from a frequency of the second frame by decreasing a magnitude of the reference voltage responsive to the pixels having a negative charge and increasing the magnitude of the reference voltage responsive to the pixels having a positive charge.

2. The electronic device of claim 1, wherein the scaler circuit is to:

control the voltage supply circuit to modify the reference voltage based on the frequency of the first frame;

transmit the first frame;

determine the frequency of the first frame differs from the frequency of the second frame; and control the voltage supply circuit to modify the reference voltage based on the frequency of the second frame.

3. The electronic device of claim 1, wherein the scaler circuit is to:

buffer a third frame;

transmit the second frame; and control the voltage supply circuit to maintain the reference voltage based on the frequency of the second frame having a same frequency as a frequency of the third frame.

4. The electronic device of claim 1, wherein the scaler circuit is to calculate a voltage to which to modify the reference voltage based on the frequency of the first frame and the frequency of the second frame.

5. The electronic device of claim 1, wherein the scaler circuit is to modify the reference voltage responsive to a charge of the pixels.

6. An electronic device, comprising:

a processor; and a display device coupled to the processor, the display device comprising:

a timing controller circuit;

a first voltage supply circuit coupled to the timing controller circuit, the first voltage supply circuit to provide a supply voltage to charge pixels in the display device;

a second voltage supply circuit coupled to the first voltage supply circuit, the second voltage supply circuit to provide a reference voltage to discharge the pixels in the display device; and a scaler circuit coupled to the second voltage supply circuit and the timing controller circuit, the scaler circuit to:

receive first and second frames from the processor;

buffer the second frame;

transmit the first frame to the timing controller circuit;

responsive to a frequency of the second frame differing from a frequency of the first frame, control the second voltage supply circuit to dynamically adjust the reference voltage by decreasing a magnitude of the reference voltage responsive to the pixels having a negative charge and increasing the magnitude of the reference voltage responsive to the pixels having a positive charge; and transmit the second frame to the timing controller circuit.

7. The electronic device of claim 6, wherein the scaler circuit comprises:

a data multiplexer to receive the first and the second frames;

a video processing circuit to buffer the second frame;

a transmission (TX) interface to transmit the first frame; and a scaling circuit to determine a voltage with which to dynamically adjust the reference voltage.

8. The electronic device of claim 6, wherein the scaler circuit is to:

receive third and fourth frames from the processor;

buffer the third and the fourth frame;

responsive to a frequency of the third frame having a same frequency as the frequency of the second frame, dynamically control the second voltage supply circuit to maintain the reference voltage;

transmit the third frame; and responsive to a frequency of the fourth frame differing from the frequency of the third frame, dynamically control the second voltage supply circuit to adjust the reference voltage.

9. An electronic device, comprising:

a first voltage supply to provide a driving signal to charge pixels in a display device, the driving signal having a variable frequency;

a second voltage supply to provide a reference signal to discharge the pixels in the display device; and a scaler circuit coupled to the second voltage supply, the scaler circuit to:

determine that a second image signal is to have a different frequency than a first image signal based on data stored in a buffer of the scaler circuit; and control the second voltage supply to vary an amplitude of the reference signal based on the determination by increasing the amplitude of the reference signal responsive to the driving signal having a positive voltage and decreasing the amplitude of the reference signal responsive to the driving signal having a negative voltage.

10. The electronic device of claim 9, wherein the display device is a thin-film transistor (TFT) liquid crystal display (LCD), an active matrix organic light emitting diode (AMOLED), an active matrix quantum dot light emitting diode (AMQLED), or a micro-light emitting diode (microLED).

11. The electronic device of claim 9, wherein the scaler circuit is to control the second voltage supply to supply a first amplitude of the reference signal during a first time frame and to supply a second amplitude of the reference signal during a second time frame, the second amplitude less than the first amplitude.

12. The electronic device of claim 11, wherein the scaler circuit is to control the second voltage supply to supply a third amplitude of the reference signal during a third time frame, the third amplitude greater than the second amplitude.

* * * * *